US008069954B2

(12) United States Patent
Kempf

(10) Patent No.: US 8,069,954 B2
(45) Date of Patent: Dec. 6, 2011

(54) SELF ERECTING ZIPPER LIFT

(75) Inventor: James Kempf, Wallkill, NY (US)

(73) Assignee: Production Resource Group, LLC, New Windsor, NY (US)

( * ) Notice: Subject to any disclaimer, the term of this patent is extended or adjusted under 35 U.S.C. 154(b) by 125 days.

(21) Appl. No.: 12/180,447

(22) Filed: Jul. 25, 2008

(65) Prior Publication Data

US 2009/0026018 A1 Jan. 29, 2009

Related U.S. Application Data

(60) Provisional application No. 60/952,173, filed on Jul. 26, 2007.

(51) Int. Cl.
*B66B 9/02* (2006.01)
*B66F 3/00* (2006.01)
*B66F 7/12* (2006.01)

(52) U.S. Cl. ..... 187/250; 254/97; 254/133 R

(58) Field of Classification Search ..... 187/250; 254/95, 97, 133 R; 474/217; 52/108, 111; *B66F 7/10, 7/06, 3/06, 13/00, 3/00, 7/12*
See application file for complete search history.

(56) References Cited

U.S. PATENT DOCUMENTS

| | | | | | |
|---|---|---|---|---|---|
| 1,925,194 | A * | 9/1933 | Long | 254/6 B |
| 2,375,462 | A * | 5/1945 | Bender | 52/108 |
| 2,554,300 | A * | 5/1951 | Hayakawa | 52/108 |
| 2,574,657 | A * | 11/1951 | Pierce | 254/1 |
| 3,012,635 | A * | 12/1961 | Blain | 187/250 |
| 3,645,146 | A * | 2/1972 | Nagin | 74/89.21 |
| 5,347,770 | A * | 9/1994 | McDonnell et al. | 52/108 |
| 5,803,418 | A * | 9/1998 | Bringolf et al. | 248/158 |
| 6,224,037 | B1 * | 5/2001 | Novick | 254/95 |
| 6,419,603 | B1 * | 7/2002 | Grasl | 474/202 |
| 7,270,619 | B2 * | 9/2007 | Bourc'His | 474/202 |
| 2004/0220004 | A1 * | 11/2004 | Bourc'His | 474/152 |

FOREIGN PATENT DOCUMENTS

| | | | |
|---|---|---|---|
| JP | 09249394 | A * | 9/1997 |
| JP | 10001291 | A * | 1/1998 |
| JP | 11139784 | A * | 5/1999 |
| JP | 2006137526 | A * | 6/2006 |
| WO | WO 9619405 | A1 * | 6/1996 |
| WO | WO 03002892 | A1 * | 1/2003 |

* cited by examiner

*Primary Examiner* — Michael Mansen
*Assistant Examiner* — Stefan Kruer
(74) *Attorney, Agent, or Firm* — Law Office of Scott C. Harris, Inc.

(57) ABSTRACT

A zipper style lift that coils into a box for storage, but extends to form a rigid, self erecting lift part. The lift stores itself in a housing when retracted, by retracting chain parts into a spiral form.

18 Claims, 6 Drawing Sheets

SELF ERECTING ZIPPER LIFT

This application claims priority to provisional application No. 60/952173, filed Jul. 26, 2007; the entire contents of which are herewith incorporated by reference.

BACKGROUND

Various commercial applications may require a self erecting column. One application is for formation of structure to use in making a show, for example a play or concert. For example, a column may need to rise up out of the stage to raise either a performer or scenery or the like.

Self-erecting columns are known, including the Gala "spiral", and the Serapid "link". These devices, however, must be externally guided to prevent collapse.

Another self erecting column is the so called ribbon lift. This can be extended without guidance, but the rising may be slow and jerky; making it inappropriate for certain applications on stage such as applications where smooth operations are desirable.

SUMMARY

The present disclosure describes a new kind of where two different separately-stored parts come together to form a lift.

DETAILED DESCRIPTION

The present application describes a new kind of lift in which the different parts of the lift fit together like a zipper, and once together, form a self-erecting column.

Figure 2:
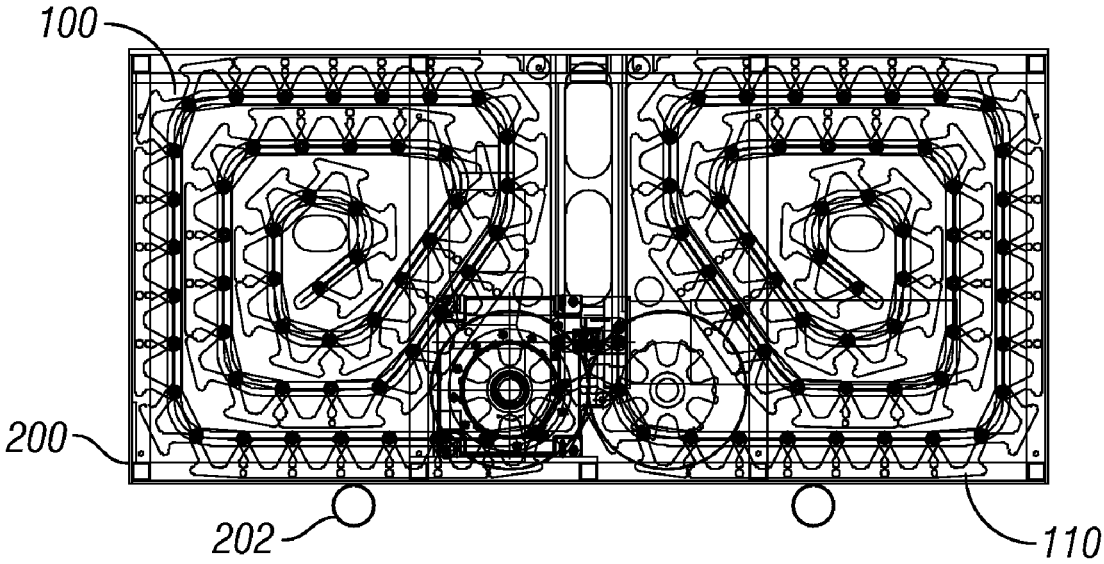
FIGS. 2 and 3 show how the parts fit in a box and then extend.

The lift is stored in its non-erected position, as two separate sections of parts. Each of the sections is arranged into a spiral. FIG. 2 shows the housing 200 with the spiral fit parts. The sections are extended from the housing box 200 to form a structural unit. For example, this mechanism may be capable of creating a freestanding, 20 foot tall structural column without the need for external guidance. The column is compact when stored, but yet structural when extended.

Figure 1:
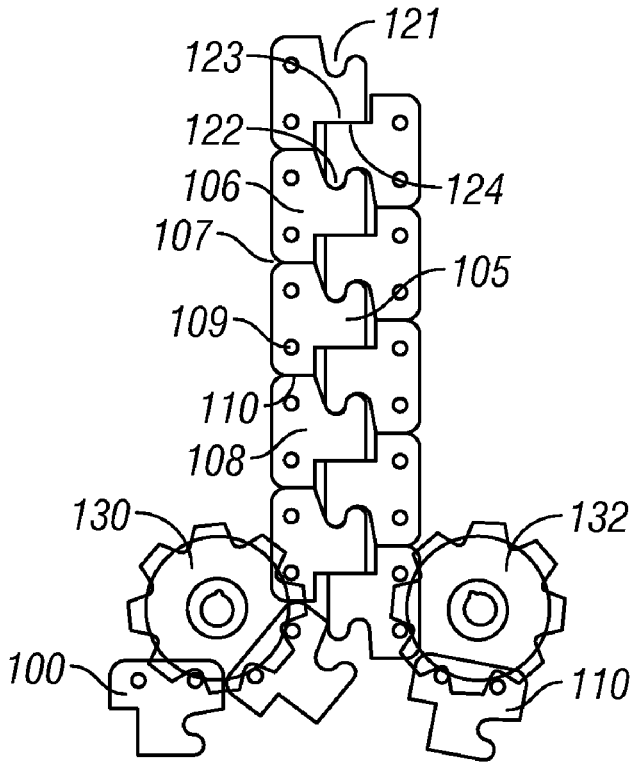
FIG. 1 shows the parts of a lift.
Figure 3:
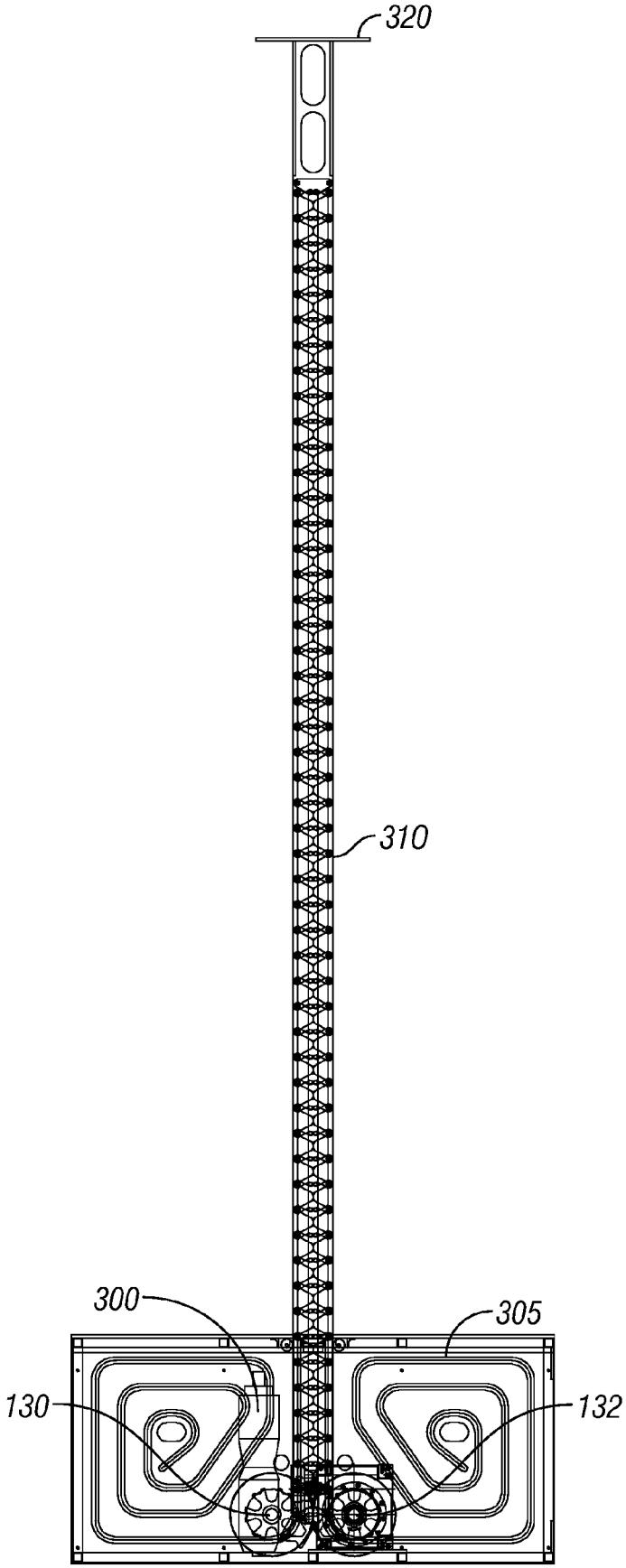

The embodiment shown in FIGS. 1 through 3.

FIG. 1 shows how a back-to-back pair of machined link sprocket chains interlock to form a rigid vertical column. When the links of the chain are individually held, they can be freely bent and pivoted relative to one another. However, the links of the chain include structure that interlocks with links on the other chain to form a rigid structure when extended.

FIG. 1 illustrates how the erected column is formed by a first chain shown generally at 100 which interlocks with a second chain shown generally as 110. Each of the chains such as 100 include a plurality of individual sprockets 105. Each of the sprockets such as 105 is intimately connected to its two neighboring sprockets 106, 108 by pivot parts such as 109. This allows each of the sprockets to pivot relative to its two neighboring sprockets. However, each of the sprockets also includes a first pressing surface such as 110 that presses on its neighbor when extended into place. The sprockets also include interlocking surfaces 121, 122 which interlock with oppositely facing sprockets when the sprocket is extended.

The interlocking portions force the sprockets into registration with one another like a zipper. Each of the sprockets has a substantially curved portion 121 that is complementary to, and interlocks with, a corresponding substantially curved portion 122 on the opposite-facing sprocket. In the embodiment, the curved portions are substantially in the shape of an "S". The sprockets also include pressing portions 123 which press against corresponding pressing portion 124 of the other sprocket. Therefore, when forced into position, the pressing portion 123 presses against the pressing portion 124, thereby holding the sprockets relative to each other.

The interlocking portion 121 interlocks with the corresponding interlocking portion 122. This provides structural strength to the extended and coupled structure. However, the two separate chain portions can be disassembled from one another.

Axles 130, 132 hold the chain parts to push them together in one direction, and to pull them apart in the other. Other surfaces in the housing may also press the chain parts together When pulled apart, the interlocking portions are removed from one another, and the pressing portions are also removed from registration with one another. Since the chains have portions that are pivotally connected to one another, these portions can be stored in any desired configuration. FIG. 2 illustrates the parts being coiled for storage based on surfaces inside the housing.

FIG. 2 illustrates how the chain 100 can be coiled on one side of a containing box 200, and how the chain 110 can be coiled on the other side of the containing box 200. In operation, a motor shown in FIG. 3 as 300 operates to rotate axles 130, 132 and forces those axles to force the chain together into its extended position shown as 310 in FIG. 3. FIG. 3 also illustrates how the box 300 has guides 305 that guide the separated chains into the coiled shape.

Extended column 310 is a rigid vertical column.

In the embodiment, the chain is formed by aluminum, computer numerically controlled cut links 106 with bronze bushings 109 that allow the links to pivot relative to one another. The links can be machined out of ⅜" aluminum, with quarter to half-inch steel shafting. When the links are in compression, they become very strong. The sprockets are mounted with keyless bushings to a pair of bearing mounted steel shafts.

The motor 300 may be a 3 hp AC Servo gear motor with hard limits. Other motors, e.g., 1-½ to 7 horsepower might be used in other embodiments. In an embodiment, the motor should be capable of moving at 3 ft/sec. In the embodiment, there is also an aluminum platform 320 at the top of the column, also formed of computer numerically controlled cut aluminum. This column allows for performers or external accessories.

In an embodiment, a 20 foot structural column mounts into the mounting case 200 which is a 30 inch wide by 48 inch tall by 84 inch long unit. The unit rides on casters 202, and also has 4 swing out jacks for stabilization.

Figure 4:
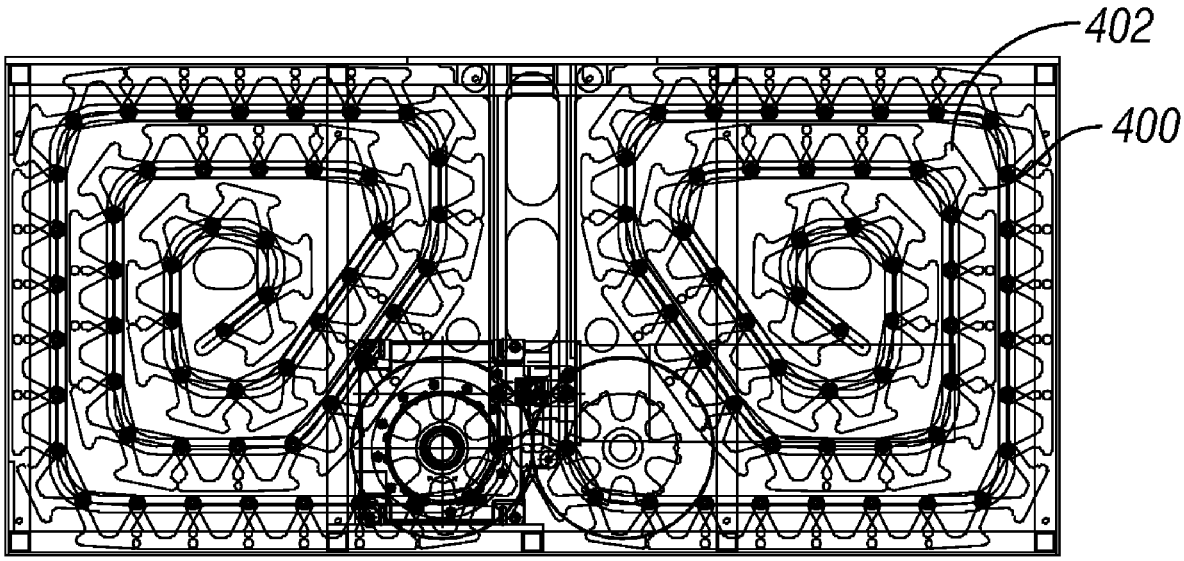
FIGS. 4 and 5 show an alternate embodiment.
Figure 5:
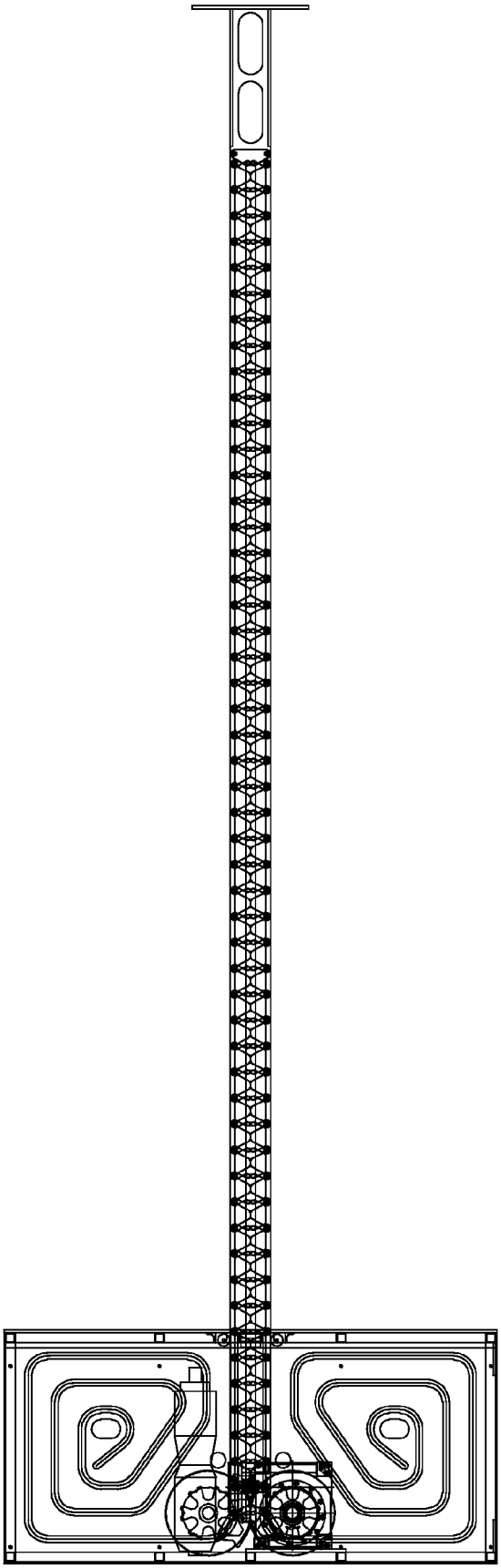

An alternative embodiment is shown in FIGS. 4 and 5. In this embodiment, the links are substantially symmetrical, with a triangular portion 400 at the bottom, and two extending portions 402 at the top. The links interconnect with one another to hold each other into place.

Figure 6:
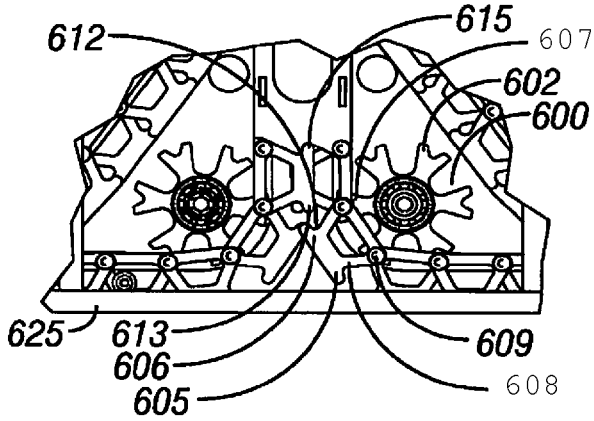
FIG. 6 shows the sprockets in the alternate embodiment.

FIGS. 6-10 illustrate an alternative embodiment. FIG. 6 illustrates an alternative style of sprocket/zipper chain. The sprockets 600 are formed with an outer shape that has an indentation 602 in the chain handling area. In this embodiment, the chain itself is formed of interconnected sections 605, 615, 625. Each of the sections 605 includes a first portion 606 having a connection to a pivotal part at 607. A second portion 608 has a connection to an opposite pivotal part 609. Each two adjacent parts are connected to each other, and can rotate relative thereto. The section 605, for example, is shown as pivoting relative to its two adjacent sections. The section 605 also defines two substantially cylindrical outer shape portions at the areas 607, 609. The indented portion 602 of the sprocket connects to those portions to drive those portions into place. Each of the sections also includes a second indented portion 612 that connects to a corresponding section 613 on a different one of the sections 615. In this way, the sections 605 and 615 interlock with each other, with following section 625 interlocking against the other side of section 605. Each of the links is laterally symmetrical. This means that a link cannot be assembled upside down within the chain, since all links are the same.

Figure 7:
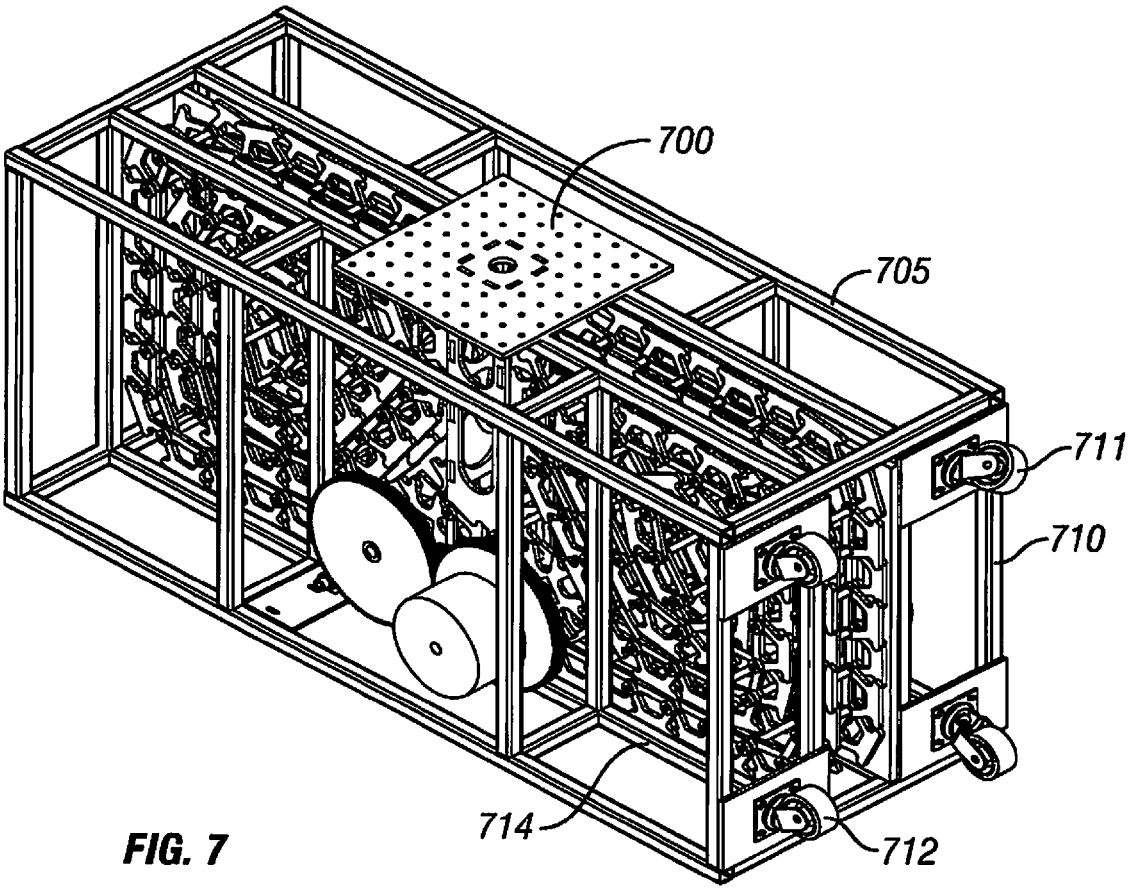
FIGS. 7-10 show the housing.
Figure 8:
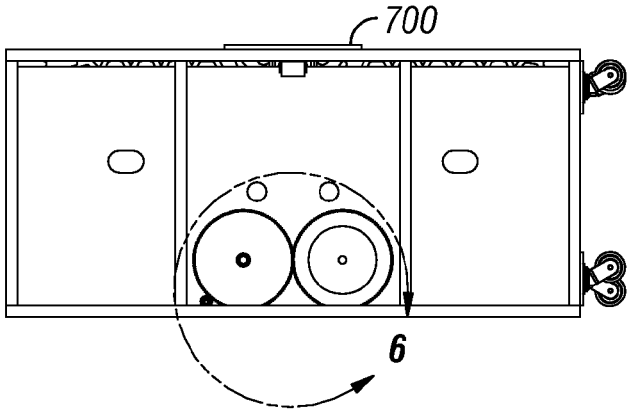
Figure 9:
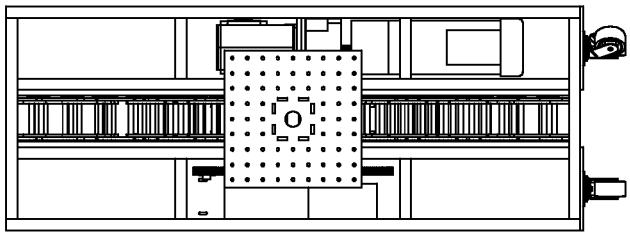
Figure 10:
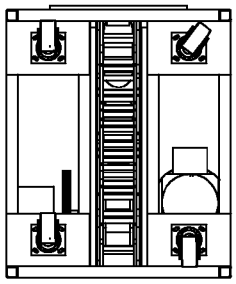

A coil that is formed by retracting of the zipper is shown in FIG. 7, showing the top platform 700, and how the zipper can be coiled into place. Each part of the chain is automatically pressed into place during the time when the chain is retracted. The chain is extended to raise the platform 700. FIG. 7 also shows the cage 705, and shows how the side end 710 includes wheels 711, 712, 713, 714. The platform can be tilted up to be moved on the wheels 711-714, and tilted down into the position shown in FIG. 7 in order to be maintained stationary. FIG. 8 shows a front on view of the device showing the sprockets. FIG. 9 shows a top view, showing how the chain 900 is coiled into a central area of the device and showing the top platform. FIG. 10 shows a side view illustrating the wheel.

The general structure and techniques, and more specific embodiments which can be used to effect different ways of carrying out the more general goals are described herein.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, the chain can take other forms. The chain can be manually extended and retracted, or can use some other structure.

Also, the inventors intend that only those claims which use the words "means for" are intended to be interpreted under 35 USC 112, sixth paragraph. Moreover, no limitations from the specification are intended to be read into any claims, unless those limitations are expressly included in the claims.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

What is claimed is:

1. A lift comprising:

a first chain, formed of first links with a first surface, and a second surface, said second surface facing oppositely said first surface, said first links that pivot relative to one another, said first links have first interlocking surfaces on said first surface, wherein said first interlocking surfaces have curved surface portions, and have third interlocking surfaces on said second surface opposite said first surface, wherein said third interlocking surfaces have a curved surface portion, and said second surface is symmetrical to said first surface;

a second chain, formed of second links with a first surface, and a second surface, said second surface facing oppositely said first surface, said first links that pivot relative to one another and have second interlocking surfaces thereon on said first surface, where said second interlocking surfaces have a curved surface portion, and have fourth interlocking surfaces on said second surface opposite said first surface, wherein said fourth interlocking surfaces have a curved surface portion, and said second surface is symmetrical to said first surface, and where curved surfaces of said second links mate to concave portions of said first interlocking surfaces of said first links on both first and second surfaces of said first links, and when mated, hold said first chain to extend in a straight line, and hold said second chain to extend in said straight line interlocked to said first chain, and when mated, prevent said first and second links from pivoting relative to one another;

a housing, holding said first and second chains;

a moving part, coupled to said housing, to extend and retract said first and second chains, said first and second chains forming a lift that extends above said housing when extended, wherein said first and second links include a first portion that includes said interlocking surfaces, a first pivot on a side of said first surface, a first leg, attached to said first pivot and said first portion, a second pivot on side of the second surface, a second leg, attached between said second pivot and said first portion, and said first and second legs having surfaces facing one another which define an open area between said first and second legs, and wherein said open area between said first and second legs is substantially polygonal in shape.

2. A lift as in claim 1, further comprising a platform at an end of the extended first and second chains.

3. A lift as in claim 2, further comprising a rotating sprocket which moves said chain, wherein said rotating sprocket connects only to a portion of the chain adjacent said legs.

4. A lift as in claim 1, further comprising at least one chain guide in said housing, guiding a position of said chain when retracted into said housing.

5. A lift as in claim 4, wherein said chain guide guides said chain into a spiral form when stored.

6. A lift as in claim 1, wherein said moving part includes an electric motor.

7. A lift as in claim 1, wherein said housing has a first surface without wheels, opposite to a direction of extension of said lift, and a second surface with wheels.

8. A lift comprising:

first and second chains that pivot relative to one another when separated, and extend in a straight line when coupled to one another;

a housing, holding said first and second chains in a retracted position, and supporting a lift part formed from said first and second chains in an extended position, said housing including first surfaces therein which guide portions of said chains to be stored and second surfaces which guide portions of said chains to be coupled, wherein said first and said second chains are each formed of links that include a first portion that includes interlocking surfaces, a first pivot on a side of said first surface, a first leg, attached to said first pivot and said first portion, a second pivot on side of the second surface, a second leg, attached between said second pivot and said first portion, and said first and second legs having surfaces facing one another which define an open area between said first and second legs, where said open area defines an area with no chain material therein, wherein said links of said chains pivot relative to one another, and are separated from each other by a distance along a direction of said chains which is at least as wide as a distance between said pivots, wherein said first and second links include a first portion that includes said interlocking surfaces, a first pivot on a side of said first surface, a first leg, attached to said first pivot and said first portion, a second pivot on side of the second surface, a second leg, attached between said second pivot and said first portion, and wherein said open area between said first and second legs is substantially polygonal in shape.

9. A lift as in claim 8, further comprising a platform at an end of the extended first and second chains.

10. A lift as in claim 8, further comprising an electric motor for extending and retracting said chain.

11. A lift as in claim 8, wherein said housing has a first surface without wheels, opposite to a direction of extension of said lift, and a second surface with wheels.

12. A lift as in claim 8, wherein said first surfaces guide said chain into a spiral form when stored.

13. A lift as in claim 8, wherein each link on each of said chains is laterally symmetrical.

14. A lift as in claim 8, wherein said first chains have first interlocking surfaces thereon which have a curved surface portion with a curved surface , and said second chain has second interlocking surfaces thereon which has a curved surface , and wherein said curved surfaces of said second chain mate to curved portions of said first chain, and said second surface is symmetrical to said first surface.

15. A method comprising:

allowing first and second chains to pivot relative to one another on a pivot when separated, moving said first and second chains to one another in a way that causes said first and second chains to extend in a straight line, wherein said moving comprises connecting an interlocking surface on a first of said chains which has both concave and convex curved surfaces to an interlocking surface on a second of said chains which also has concave and convex surfaces, and where the convex surfaces on said second chain are connected to the corresponding concave surfaces on the first chain, said moving comprising using a sprocket which connects only to a portion of said chain adjacent to said pivot, and which defines an open space between portions of said sprocket where said open space does not include material that couples against said chain, said open space formed between two adjacent sprocket portions, said sprocket having a central portion, and said moving also comprising applying a rotating force to said central sprocket portion;

holding said first and second chains in a retracted position in a housing separated from one another; and supporting an extended lift part formed from said first and second chains in an extended position above the ground, using said housing for the support, wherein said first and second links include a first portion that includes said interlocking surfaces, a first pivot on a side of said first surface, a first leg, attached to said first pivot and said first portion, a second pivot on side of the second surface, a second leg, attached between said second pivot and said first portion, and said first and second legs having surfaces facing one another which define an open area between said first and second legs, and , wherein said open area between said first and second legs is substantially polygonal in shape.

16. A method as in claim 15, further comprising using an electric motor for extending and retracting said lift.

17. A method as in claim 15, further comprising guiding said chain into a spiral form when stored.

18. A lift as in claim 15, wherein each of said chains have a curved surface portion on each of first and second opposite facing surfaces.

* * * * *